US005231856A

United States Patent [19]

Lonati et al.

[11] Patent Number: 5,231,856

[45] Date of Patent: Aug. 3, 1993

[54] TWIN-CYLINDER CIRCULAR KNITTING MACHINE FOR MANUFACTURING SOCKS AND STOCKINGS WITH A KNITTED FABRIC TENSIONING DEVICE

[75] Inventors: Francesco Lonati; Ettore Lonati; Fausto Lonati; Tiberio Lonati, all of Brescia, Italy

[73] Assignee: Lonati S.r.l., Monza, Italy

[21] Appl. No.: 885,782

[22] Filed: May 20, 1992

[30] Foreign Application Priority Data

May 31, 1991 [IT] Italy ..... MI91A001493

[51] Int. Cl.[5] ..... D04B 35/00

[52] U.S. Cl. ..... 66/147; 66/149 S

[58] Field of Search ..... 66/147, 149 R, 149 S

[56] References Cited

U.S. PATENT DOCUMENTS

| | | | |
|---|---|---|---|
| 3,214,944 | 11/1965 | Kiemel | 66/149 R |
| 3,797,280 | 3/1974 | Lonati | 66/149 R |
| 4,516,410 | 5/1985 | Lonati | 66/149 R X |
| 4,665,720 | 5/1987 | Beroncini et al. | 66/149 R X |
| 4,945,734 | 8/1990 | Maruyama | 66/147 X |

FOREIGN PATENT DOCUMENTS

| | | | |
|---|---|---|---|
| 1412180 | 8/1965 | France . | |
| 2364991 | 4/1978 | France . . | |
| 2035390 | 6/1980 | United Kingdom | 66/149 S |
| 2037329 | 7/1980 | United Kingdom | 66/147 |

*Primary Examiner*—Clifford D. Crowder
*Assistant Examiner*—John J. Calvert
*Attorney, Agent, or Firm*—Guido Modiano; Albert Josif

[57] ABSTRACT

The twin-cylinder circular knitting machine with knitted fabric tensioning device having members for retaining the fabric proximate to a knitting forming region. A first fluid-activated piston is accommodated in the upper needle cylinder and is provided with a hollow stem which is open at its ends. The lower end of the stem is engageable, by means of the sliding of the piston parallel to the axis of the needle cylinders, with the knitted fabric being formed in order to apply tension thereto. The retention members have dimensions for allowing the stem to slide outside of the retention members. The tensioning device also has an auxiliary actuation piston which acts on the piston to achieve its descent at a controlled rate at least until the lower end of the stem of the piston makes contact with the fabric in the region comprised between the retention members and the knitting forming region.

19 Claims, 4 Drawing Sheets

TWIN-CYLINDER CIRCULAR KNITTING MACHINE FOR MANUFACTURING SOCKS AND STOCKINGS WITH A KNITTED FABRIC TENSIONING DEVICE

BACKGROUND OF THE INVENTION

The present invention relates to a twin-cylinder circular knitting machine for manufacturing socks and stockings with knitted fabric tensioning device.

Twin-cylinder circular knitting machines are known which have a device for applying tension to the knitted fabric. The device comprises an element for retaining the initial portion of the fabric which is arranged inside the lower needle cylinder proximate to the region where the knitting is formed, and a fluid-activated piston provided with a hollow stem which is open at its ends and can slide inside a cylindrical chamber defined coaxially in the upper needle cylinder.

The retention element faces the lower end of the stem of the piston, and its dimensions are such as to allow the descent of the stem into the lower needle cylinder, passing around said retention element so as to apply tension to the fabric which extends from the retention region to the region of the machine where knitting is formed.

The upper end of the stem can be connected to an aspiration device which aspirates the fabric at the end of the knitting and turns it inside out.

The descent of the piston in order to apply tension to the fabric being formed is obtained by gravity by providing appropriate piston weighting elements, whereas the ascent of the piston is caused by a pressurized fluid which is fed into the cylindrical chamber.

These known types of twin-cylinder machines with device for applying tension to the fabric have some problems.

Due to the fact that the piston stem descends by gravity, damage to the fabric may occur due to excessive traction stresses, particularly in the initial portion of the fabric, when the lower end of the stem makes contact with the fabric and the weight of the piston, the stem and the weighting elements bears on a short length of fabric.

Furthermore, since the stem of the piston is rigidly associated with the upper needle cylinder in rotation about its axis, while the cylindrical chamber in which it slides is defined by a tubular body which is fixed to the supporting structure of the upper needle cylinder, there occurs rapid wear of the gaskets interposed between the piston and the tubular body in which it slides.

The tension application device is furthermore provided with an engagement device which is mounted on the supporting structure of the upper needle cylinder and can engage the piston in order to keep it in a raised position when the application of tension to the fabric is not required. The use of the engagement device which must engage the piston, which rotates together with the upper needle cylinder, complicates the connection between said two elements.

SUMMARY OF THE INVENTION

The aim of the present invention is to obviate the above described problems by providing a twin-cylinder circular knitting machine for manufacturing socks and stockings with a device for applying tension to the fabric which effectively avoids excessive stresses of the fabric so as to ensure its integrity even in the case of fabrics having scarce mechanical strength.

Within the scope of this aim, an object of the invention is to provide a machine with a device for applying tension to the fabric which in any case ensures the application of adequate tension to the fabric during its formation.

Another object of the invention is to provide a device for applying tension to the fabric which has reduced problems of wear of the sealing elements and has a relatively simple construction.

This aim, these objects and others which will become apparent hereinafter are achieved by a twin-cylinder circular knitting machine for manufacturing socks and stockings with a knitted fabric tensioning device, comprising a lower needle cylinder and an upper needle cylinder which are mutually coaxial and activatable with rotary motion about their common axis, a device for applying tension to the knitted fabric being accommodated inside said needle cylinders, said device comprising: means for retaining the fabric proximate to the knitting forming region; a first fluid-activated piston accommodated in said upper needle cylinder and provided with a hollow stem which is open at its ends, the lower end of said stem being engageable, by means of the sliding of said piston parallel to the axis of the needle cylinders, with the knitted fabric being formed in order to apply tension thereto; said retention means having dimensions for allowing said stem to slide outside said retention means, characterized in that it comprises auxiliary actuation means which act on said piston for its descent at a controlled rate at least until the lower end of said stem makes contact with the fabric in the region comprised between said retention means and the knitting forming region, said retention means and said stem being rigidly associated with said upper needle cylinder in rotation about its axis.

BRIEF DESCRIPTION OF THE DRAWINGS

Further characteristics and advantages of the invention will become apparent from the description of a preferred but not exclusive embodiment of the machine with device for applying tension to the fabric according to the invention, illustrated only by way of non-limitative example in the accompanying drawings, wherein.

DESCRIPTION OF THE PREFERRED EMBODIMENTS

Figure 1:
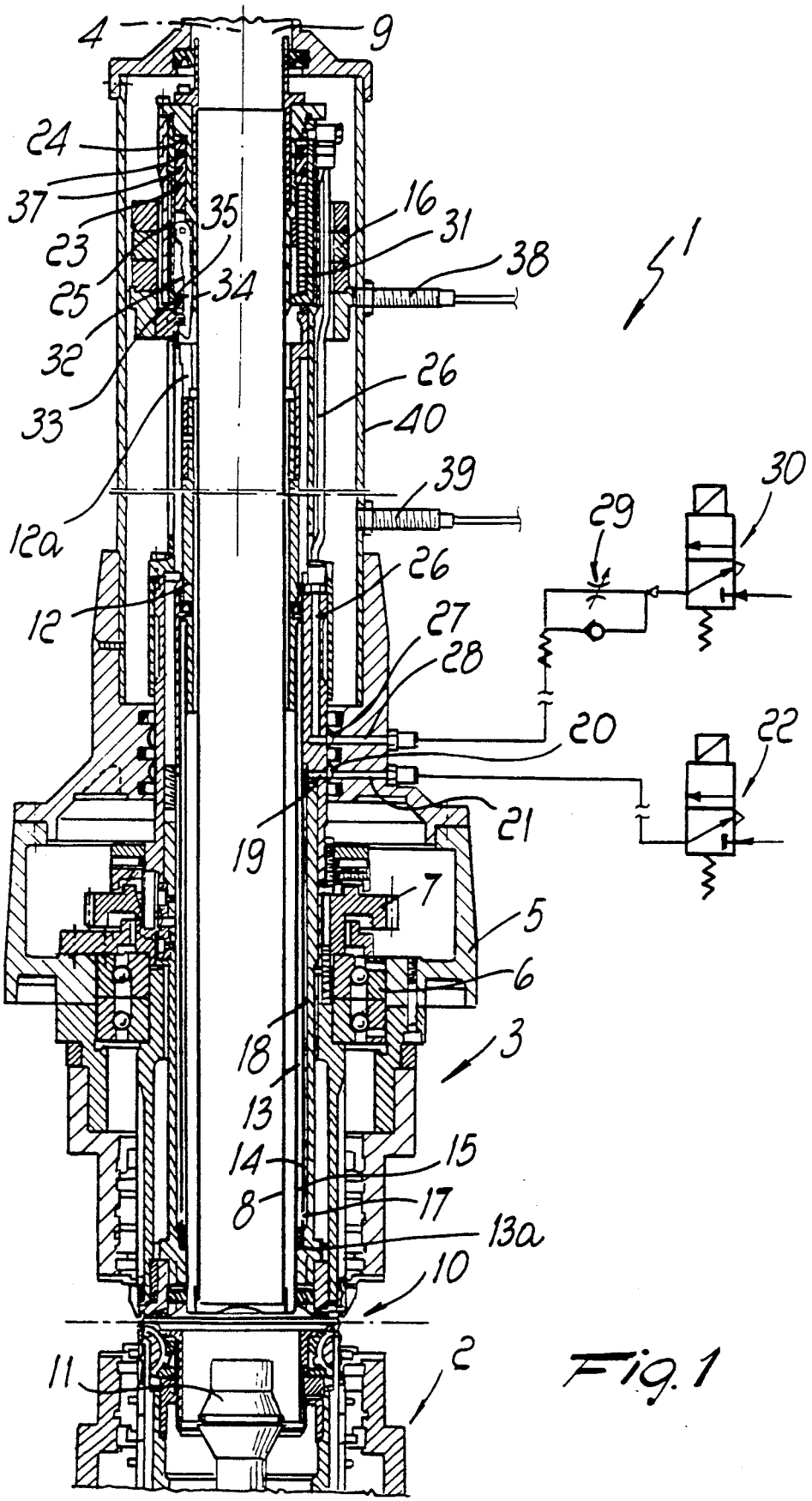
FIG. 1 is an axial sectional view of the upper needle cylinder and of part of the lower needle cylinder of the machine according to the invention, with the fabric tension application device in an inactive condition.

With reference to the above figures, the machine according to the invention, generally designated by the reference numeral 1, comprises a lower needle cylinder 2 and an upper needle cylinder 3 which are mutually coaxial and activatable with rotary motion about their common axis 4.

In particular, the upper needle cylinder 3 is supported so as to be rotatable about the axis 4 by a supporting structure 5 by means of a main bearing 6. The rotary actuation of the upper needle cylinder is obtained, in a known manner, by means of a motor, not illustrated for the sake of simplicity, which is connected to a gearwheel 7 fixed coaxially to the upper needle cylinder 3.

A first tubular body 8 is arranged inside the upper needle cylinder 3 and coaxially thereto, is rigidly associated with said upper needle cylinder in rotating about the axis 4 and is connected, with its upper end, to a duct 9 which can be controllably connected to an aspiration device. The lower end of the first tubular body 8 faces the lower needle cylinder 2 and is arranged proximate to the knitting forming region 10.

The machine according to the invention is provided with a device for applying tension to the fabric comprising fabric retention means which are conveniently constituted by a plug-like element 11 which can slide, in a known manner, inside the lower needle cylinder 2 along the axis 4, in order to engage in the lower end of the first tubular body 8 so as to block the initial end of the fabric which is aspirated along the first tubular body 8.

The fabric tension application means also comprise a first piston 12 which is arranged around the first tubular body 8. The first piston 12 is provided with a hollow stem 15 which is open at its ends, surrounds said first tubular body 8 and extends toward the lower needle cylinder 2. The piston 12, with its stem 15, is arranged between the first tubular body 8 and a second tubular body 14 which is fixed inside the upper needle cylinder for a portion of its length. A first chamber 13 with an annular cross-section is defined between the piston 12-stem 15 assembly and the tubular body 14, on the inner surface of which the piston 12 slides; said chamber is delimited upwardly by a gasket of the piston 12 and downwardly by a gasket 13*a* which makes contact with the stem 15.

The piston 12 furthermore has an upper extension 12*a* with which weighting elements 16 are associated in order to facilitate its descent.

The chamber 13 with annular cross-section is connectable to a source of pressurized fluid in order to raise the piston 12. More particularly, a passage 17 is defined in the second tubular body 14, proximate to the lower end of the chamber 13, and connects the chamber 13 to an interspace 18 defined between the second tubular body 14 and the inner surface of the upper needle cylinder 3. The interspace 18 is connected, through a hole 19, to an annular groove 20, defined between the outer surface of the upper needle cylinder 3 and a portion of the supporting structure 5, which is in turn connected to a duct 21 on which a controllable electric valve 22 is arranged. Through the electric valve 22, the chamber with annular cross-section 13 is connectable either to a source of pressurized fluid, for example air, in order to raise the piston 12, or to a discharge to allow its descent.

According to the invention, auxiliary actuation means are provided which act on the piston 12 in order to make it descend at a controlled rate, at least until the lower end of the stem 15 makes contact with the fabric.

Said auxiliary actuation means are constituted by a second piston 23, which is arranged above the first piston 12 and can slide inside a second chamber 24 with annular cross-section defined between the first tubular body 8 and a third tubular body 25, rigidly associated with the first tubular body 8 in rotation about the axis 4.

The chamber 24 is connected, above the piston 23, to a duct 26 which partially extends inside the upper needle cylinder 3 and, similarly to the interspace 18, is connected to an annular recess 27 defined between the outer surface of the upper needle cylinder 3 and a portion of the supporting structure 5, which is in turn connected to a further duct 28 on which a flow regulator 29 and an electric valve 30 are arranged; said electric valve can be controllably connected to a source of pressurized fluid, for example air, or to a discharge.

Springs 31 for the return of the piston 23 are arranged in the chamber 24 below the piston 23.

The second piston 23 is provided with retention means 32 which can be controllably engaged with, or disengaged from, the extension 12*a* of the first piston 12. Said retention means are constituted by hook-like elements 33 which are associated with the second piston 23 and protrude downward from the second chamber 24.

Each hook-like element 33 is pivoted to the piston 23 with its upper end so that it can oscillate in a plane which is radial to the upper needle cylinder so that its lower end engages with, or disengages from, the extension 12*a* of the piston 12.

The oscillation of the hook-like elements 33 is obtained by means of cam-shaped abutments 34 and 35 which are applied respectively to the first tubular body 8 and to the inner surface of the third tubular body 25, so as to cause an oscillation of the hook-like elements toward the axis 4, when the piston 23 has completed its descent in order to disengage from the extension 12*a* of the piston 12, and in the opposite direction, when the piston 23 is completing its ascent in order to engage the extension 12*a*.

It should be noted that the assembly constituted by the first tubular body 8, by the second piston 2 with hook-like elements 33 and by the third tubular body 35, as well as the assembly constituted by the first piston 12 and by the second tubular body 14, is rigidly associated with the upper needle cylinder, and thus there is a reduced wear of the gaskets 36 and 37 arranged on the pistons 12 and 23 and the use of bearings for connection between the various elements is not required.

Conveniently, means are provided for detecting the axial position of the first piston 12; said means are constituted by a pair of sensors 38 and 39, for example of the electromagnetic type, which are spaced along the axis 4 and are applied to a housing 40 which is fixed to the supporting structure 5 and surrounds the upper portion of the first tubular body 8.

The operation of the fabric tension application device according to the invention is as follows.

When the knitting of the fabric begins, the plug-like element 11 is spaced downward from the first tubular body 8, which is connected to an aspiration device so as to draw inside it the initial portion of the formed knitted fabric. The first piston 12 is engaged by the hook-like elements 33, and the second piston 23 is in the maximum rise condition by virtue of the action of the springs 31, since the second chamber 24 is connected to the atmosphere by the electric valve 30 (FIG. 1).

Figure 2:
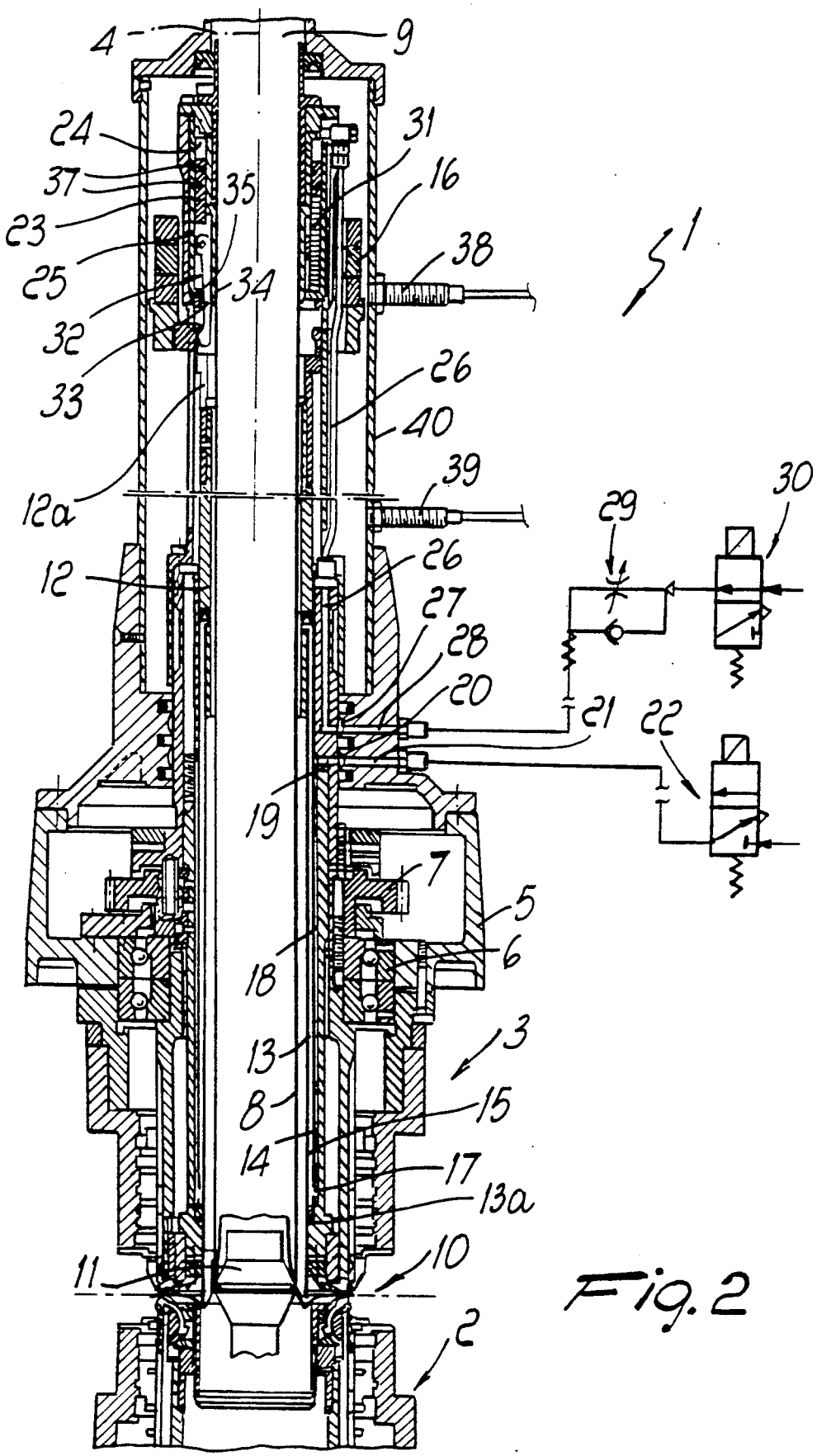
FIGS. 2 to 4 are sectional views of the machine, taken similarly to FIG. 1, illustrating the operation of the fabric tension application device.

After the initial portion of fabric has been drawn into the first tubular body 8, the plug-like element 11 is raised so as to enter the lower end of the first tubular body 8, locking the fabric. At this stage, the position of the electric valve 30 is switched so as to cause the progressive descent of the second piston 23 and of the first piston 12, which is still engaged with the hook-like elements 33. The descent rate of the first piston 23 can be adjusted by means of an appropriate setting of the flow regulator 29, so that the contact of the lower end of the stem 15 with the fabric in the region comprised between the first tubular body 8 and the knitting forming region 10 occurs without damaging the fabric, even in the case of fabrics having low mechanical strength (FIG. 2).

Figure 3:
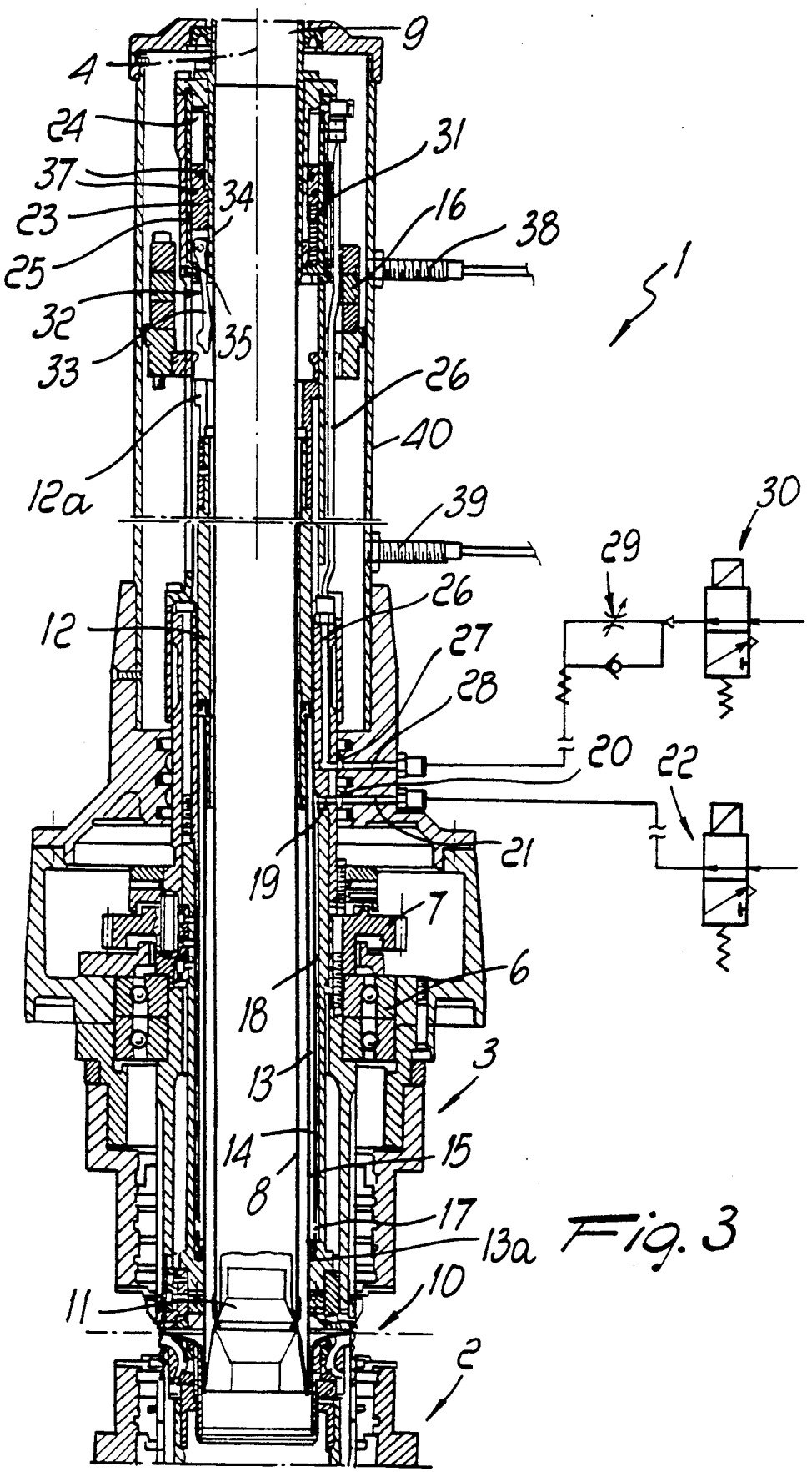

After the lower end of the stem 15 has made contact with the fabric and the application of tension thereto has thus begun, i.e. when the second piston 23 has almost completed its descent, the hook-like elements 33 are disengaged, by virtue of the action of the abutment 35, from the first piston 12, which continues its descent by gravity, continuing to apply tension to the fabric (figure 3).

Figure 4:
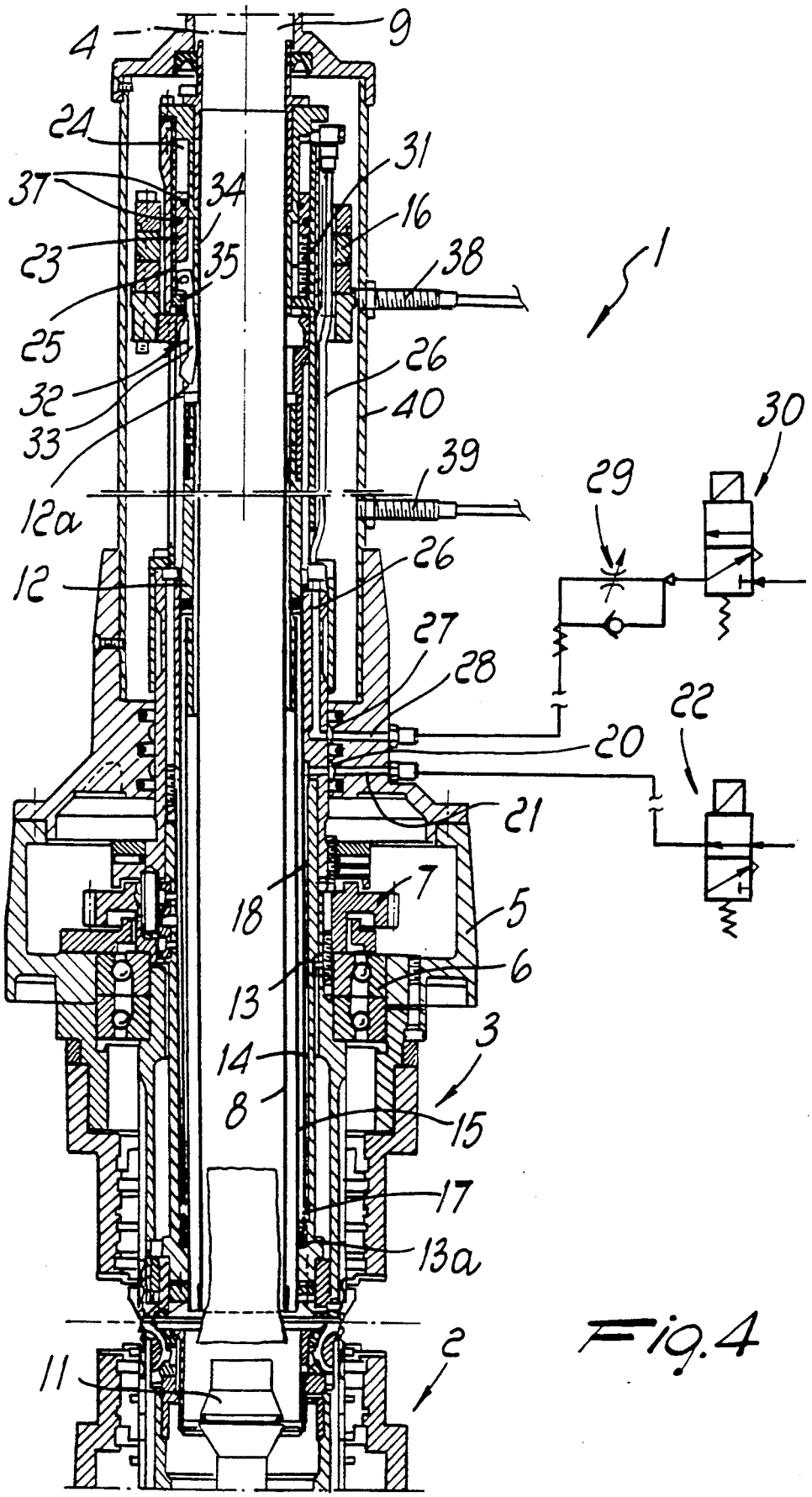

At the end of the formation of the fabric, the first chamber 13, which has so far been connected to the atmosphere, is connected by means of the electric valve 22 to a source of compressed air so as to raise the first piston 12 (FIG. 4), while the plug-like element 11 is disengaged from the first tubular body 8 so that the fabric is drawn along said first tubular body 8 and unloaded, in a known manner, outside the machine.

At the end of the ascent of the piston 12, the position of the electric valve 30 is switched again; by connecting the second chamber 24 to the atmosphere, said electric valve raises the second piston 23, with consequent engagement of the hook-like elements 33 with the extension 12*a* by virtue of the presence of the abutment 34.

At this stage, the position of the electric valve 22 is switched again, and the cycle restarts as already described.

In practice it has been observed that the machine with the tension application device according to the invention fully achieves the intended aim, since by allowing to adjust the descent rate of the tension application piston so as to contain the stresses discharged onto the fabric at the moment of contact, it avoids ripping and tearing of the fabric when tensioning begins.

Furthermore, by virtue of the fact that the actuation elements which make contact with the tension application cylinder are rigidly associated with the upper needle cylinder in its rotation about its axis, reduced wear occurs and the entire arrangement of the fabric tensioning device is simplified.

The machine with the fabric tensioning device thus conceived is susceptible to numerous modifications and variations, all of which are within the scope of the inventive concept; all the details may furthermore be replaced with technically equivalent elements.

In practice, the materials employed, as well as the dimensions, may be any according to the requirements and the state of the art.

We claim:

1. Twin-cylinder circular knitting machine for manufacturing socks and stockings with a knitted fabric tensioning device, comprising a lower needle cylinder and an upper needle cylinder which are mutually coaxial and activatable with rotary motion about their common axis, a device for applying tension to the knitted fabric being accommodated inside said needle cylinders, said device comprising: means for retaining the fabric proximate to the knitting forming region; a first fluid-activated piston, accommodated in said upper needle cylinder and provided with a hollow stem open at upper and lower ends, the lower end of said stem being engageable with the knitted fabric, by sliding said piston parallel to the axis of the needle cylinders to apply tension thereto; said retention means having dimensions for allowing said stem to slide outside said retention means, said tensioning device further comprising auxiliary actuation means which act on said piston to allow descent at a controlled rate at least until the lower end of said stem makes contact with the fabric in the region between said retention means and the knitting forming region, said retention means and said stem being rigidly associated with said upper needle cylinder in rotation about the axis, wherein said auxiliary actuation means comprise a second fluid-activated piston arranged above said first piston and provided with means for retaining said first piston, said first piston being slideable downwardly by gravity, said second piston being actuatable for controlling the descent rate of said first piston at least until said stem makes contact with the fabric.

2. Machine according to claim 1, wherein said retention means are disengageable from said first piston in order to allow descent by gravity of the retention means after said stem makes contact with said fabric.

3. Machine according to claim 1, wherein said second fluid-activated piston with said retention means is rigidly rotatively associated with said upper needle cylinder in rotation about the axis.

4. Machine according to claim 1, wherein said first piston is slideable axially in a second tubular body fixed coaxially inside the upper needle cylinder, said second tubular body being external and coaxial to said first tubular body, a first cylindrical chamber being defined between said first piston and the inner surface of said second tubular body, said first cylindrical chamber being controllably connectable to a source of pressurized fluid or to a discharge for the ascent or descent of said first piston.

5. Machine according to claim 4, wherein said second piston is slideably accommodated in a second cylindrical chamber defined around said first tubular body above said first cylindrical chamber, said second cylindrical chamber being controllably connectable, above said second piston, to a source of pressurized fluid for the controlled descent of said second piston against action of an elastic return means.

6. Machine according to claim 1, wherein said retention means comprise at least one hook-like element connected downwardly to said second piston and engageable with an upper extension of said first piston.

7. Machine according to claim 6, wherein cam-like abutments are arranged proximate to said hook-like element and interact with said hook-like element upon the ascent or descent of said second piston for engagement or disengagement of said hook-like element with or from said first piston.

8. Machine according to claim 6, wherein weighting elements are associated with said extension of the first piston for facilitating descent during the application of tension to the fabric.

9. Machine according to claim 1, further comprising means for detecting an axial position of said first piston.

10. Twin-cylinder circular knitting machine for manufacturing socks and stockings with a knitted fabric tensioning device, comprising a lower needle cylinder and an upper needle cylinder which are mutually coaxial and activatable with rotary motion about their common axis, a device for applying tension to the knitted fabric being accommodated inside said needle cylinders, said device comprising: means for retaining the fabric proximate to the knitting forming region; a first fluid-activated piston, accommodated in said upper needle cylinder and provided with a hollow stem open at upper and lower ends, the lower end of said stem being engageable with the knitted fabric, by sliding said piston parallel to the axis of the needle cylinders to apply tension thereto; said retention means having dimensions for allowing said stem to slide outside said retention means, said tensioning device further comprising auxiliary actuation means which act on said piston to allow descent at a controlled rate at least until the lower end of said stem makes contact with the fabric in the region between said retention means and the knitting forming region, said retention means and said stem being rigidly associated with said upper needle cylinder in rotation about the axis, wherein said auxiliary actuation means include means for retaining said first piston, said first piston being slideable downwardly by gravity, said auxiliary actuation means being actuatable for controlling the descent rate of said first piston at least until said stem makes contact with the fabric.

11. Machine according to claim 10, wherein said auxiliary actuation means comprise a second fluid-activated piston arranged above said first piston, and wherein said means for retaining said first piston are disengageable from said first piston to allow descent by gravity of the retention means after said stem makes contact with the fabric.

12. Machine according to claim 11, wherein said second fluid-activated piston with said retention means is rigidly rotatively associated with said upper needle cylinder in rotation about the axis.

13. Machine according to claim 11, wherein a first tubular body is arranged coaxially inside said upper needle cylinder and is connectable to an aspiration device, said first tubular body having a lower end arranged proximate to the region where the knitting is formed, said retention means being constituted by a plug-like element axially slideable inside said lower needle cylinder and insertable in the lower end of said first tubular body to block an initial portion of the fabric being formed between the inner surface of said first tubular body and said plug-like element.

14. Machine according to claim 11, wherein said first piston is slideable axially in a second tubular body fixed coaxially inside the upper needle cylinder, said second tubular body being external and coaxial to said first tubular body, a first cylindrical chamber being defined between said first piston and the inner surface of said second tubular body, said first cylindrical chamber being controllably connectable to a source of pressurized fluid or to a discharge for the ascent or descent of said first piston.

15. Machine according to claim 14, wherein said second piston is slideably accommodated in a second cylindrical chamber defined around said first tubular body above said first cylindrical chamber, said second cylindrical chamber being controllably connectable, above said second piston, to a source of pressurized fluid for the controlled descent of said second piston against action of an elastic return means.

16. Machine according to claim 11, wherein said retention means comprise at least one hook-like element connected downwardly to said second piston and engageable with an upper extension of said first piston.

17. Machine according to claim 16, wherein cam-like abutments are arranged proximate to said hook-like element and interact with said hook-like element upon the ascent or descent of said second piston for engagement or disengagement of said hook-like element with or from said first piston.

18. Machine according to claim 16, wherein weighting elements are associated with said extension of the first piston for facilitating descent during the application of tension to the fabric.

19. Machine according to claim 10, further comprising means for detecting an axial position of said first piston.

* * * * *